US007954476B2

(12) United States Patent
Murakoshi et al.

(10) Patent No.: US 7,954,476 B2
(45) Date of Patent: Jun. 7, 2011

(54) FUEL SUPPLY DEVICE

(75) Inventors: Yuichi Murakoshi, Obu (JP); Koji Yoshida, Obu (JP)

(73) Assignee: Aisan Kogyo Kabushiki Kaisha, Obu-shi, Aichi-ken (JP)

( * ) Notice: Subject to any disclaimer, the term of this patent is extended or adjusted under 35 U.S.C. 154(b) by 256 days.

(21) Appl. No.: 12/471,684

(22) Filed: May 26, 2009

(65) Prior Publication Data

US 2009/0293966 A1 Dec. 3, 2009

(30) Foreign Application Priority Data

May 29, 2008 (JP) ..... 2008-141668

(51) Int. Cl.
*F02M 37/04* (2006.01)

(52) U.S. Cl. ..... 123/509

(58) Field of Classification Search ..... 123/509
See application file for complete search history.

(56) References Cited

U.S. PATENT DOCUMENTS 5,762,481 A * 6/1998 Oi ..... 417/423.3
6,302,144 B1 * 10/2001 Graham et al. ..... 137/565.17
7,458,365 B2 * 12/2008 Hazama ..... 123/509
7,497,208 B2 * 3/2009 Satoh et al. ..... 123/509
7,808,784 B2 * 10/2010 Graf ..... 361/704
7,827,969 B2 * 11/2010 Yamamoto et al. ..... 123/509
7,854,598 B2 * 12/2010 Suzuki ..... 417/361
2005/0100461 A1 5/2005 Izutani et al.

FOREIGN PATENT DOCUMENTS

JP 8177668 7/1996
JP 2004169565 6/2004
JP 2005155602 6/2005

* cited by examiner

*Primary Examiner* — Thomas N Moulis
(74) *Attorney, Agent, or Firm* — Dennison, Schultz & MacDonald

(57) ABSTRACT

A fuel supply device comprises a fuel pump, a set plate, a control circuit, and an electrical wiring member. The fuel pump is disposed within a fuel tank. The set plate closes an opening of the fuel tank. The set plate comprises a controller chamber isolated from the fuel tank. The control circuit is disposed within the controller chamber. The control circuit controls the fuel pump. The electrical wiring member connects the control circuit and the fuel pump. The electrical wiring member is arranged from an interior of the controller chamber to an interior of the fuel pump and is passed through the set plate. A part of the electrical wiring member is exposed to the atmosphere. Furthermore, the exposed part is disposed within a range from the interior of the fuel tank to the interior of the controller chamber.

14 Claims, 12 Drawing Sheets

FUEL SUPPLY DEVICE

CROSS-REFERENCE TO RELATED APPLICATION

This application claims priority to Japanese Patent Application No. 2008-141668, filed on May 29, 2008, the contents of which are hereby incorporated by reference into the present application.

BACKGROUND OF THE INVENTION

1. Field of the Invention

The present invention relates to a fuel supply device. In particular, the present invention relates to a technique for preventing fuel from entering a controller chamber in which a control circuit that controls a fuel pump is housed.

2. Description of the Related Art

Japanese Patent Application Publication No. 2004-169565 teaches a fuel supply device that supplies fuel to an internal combustion engine of, for example, a motor vehicle. This fuel supply device comprises a fuel pump, a set plate that covers an opening of the fuel tank, and a control circuit that controls the fuel pump. The control circuit is housed in a controller chamber formed on the set plate. The control circuit is connected with the fuel pump by an electrical wiring member that passes through the set plate and extends into the fuel tank.

In the fuel supply device described above, the fuel within the fuel tank may enter a minute clearance between the set plate and electrical wiring member and may travel along the electrical wiring member and may enter the controller chamber. In order to prevent this leakage, in the fuel supply device described above, a leakage prevention agent is applied to a part of the electrical wiring member.

SUMMARY OF THE INVENTION

However, it is difficult to prevent fuel from traveling along the electrical wiring member and entering the controller chamber merely by applying a leakage prevention agent.

In the present specification, disclosed herein is a technique for more effectively preventing fuel from entering the controller chamber.

In order to resolve the above problem, a fuel supply device disclosed in the present specification comprises a fuel pump, a set plate, a control circuit and an electrical wiring member. The fuel pump is disposed within a fuel tank. The set plate closes an opening of the fuel tank. The set plate comprises a controller chamber isolated from an interior of the fuel tank. The control circuit is disposed within the controller chamber. The control circuit controls the fuel pump. The electrical wiring member connects the control circuit and the fuel pump. The electrical wiring member is arranged from an interior of the controller chamber to the interior of the fuel tank and is passed through the set plate therebetween. A part of the electrical wiring member is exposed to the atmosphere. Furthermore, the exposed part is disposed within a range from the interior of the fuel tank to the interior of the controller chamber.

In this fuel supply device, the electrical wiring member extends from the inside of the controller chamber to the inside of the fuel tank while penetrating through the set plate on the way thereto. In such a configuration, the fuel within the fuel tank travels along the electrical wiring member toward the controller chamber. In the fuel supply device, however, since a part of the electrical wiring member is exposed to the atmosphere, the fuel diffuses into the atmosphere at that position, and the fuel is thus prevented from entering the controller chamber.

DESCRIPTION OF THE PREFERRED EMBODIMENTS

First Embodiment

Figure 1:
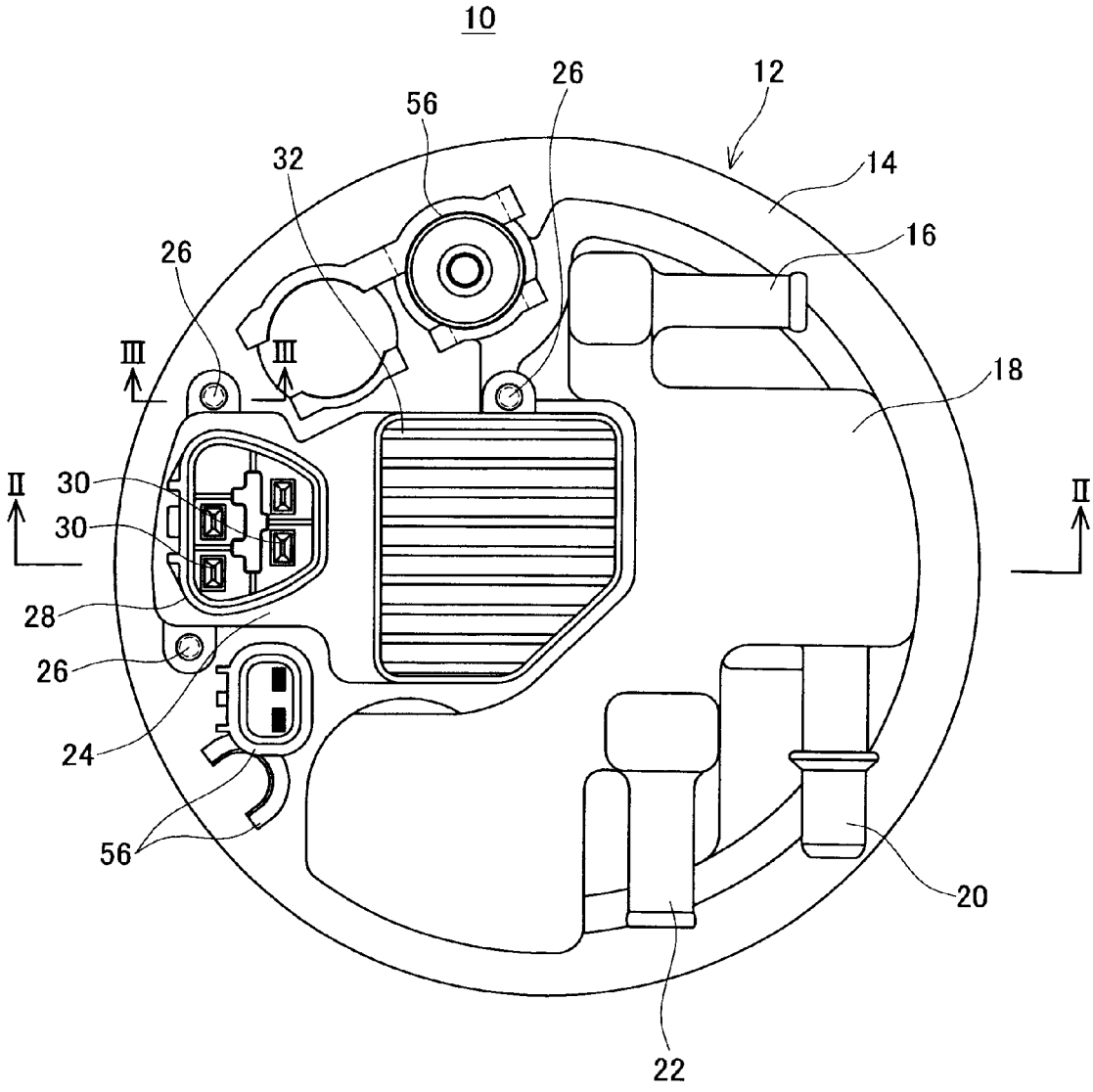
FIG. 1 is a plan view of a fuel supply device of a first embodiment.
Figure 2:
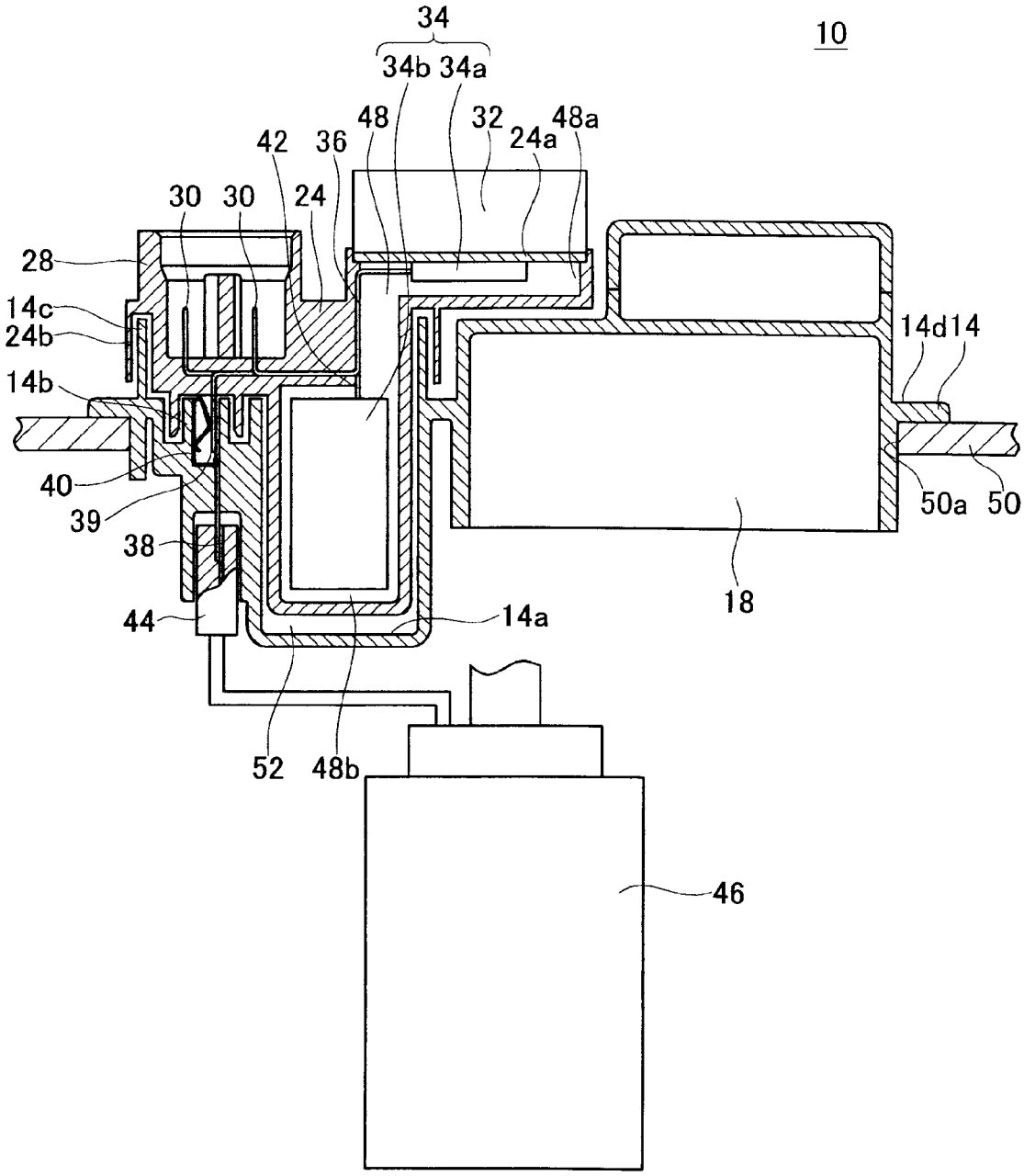
FIG. 2 is a cross-sectional view showing a cross-section along II-II of FIG. 1.

A first embodiment of a fuel supply device will be described with reference to figures. In the present embodiment, a fuel supply device that supplies gasoline to an engine of a motor vehicle will be described. FIG. 1 shows a plan view of a fuel supply device 10. FIG. 2 is a cross-sectional view showing a cross-section along II-II of FIG. 1.

As shown in FIGS. 1 and 2, the fuel supply device 10 comprises a fuel pump 46, a set plate 12, a control circuit 34, an external connector 28, and a canister 18, etc.

The set plate 12 is made from resin. The set plate 12 comprises a plate body 14 and a case 24. The plate body 14 fits with an opening 50*a* of a fuel tank 50, and covers the opening 50*a*. The plate body 14 has an outer peripheral edge 14*d*. The outer peripheral edge 14*d* makes contact with an upper surface of the fuel tank 50 in a condition that the plate body 14 is fitted within the opening 50*a*. As a result, the set plate 12 is positioned on the upper surface of the fuel tank 50. The canister 18 is formed in the plate body 14. An atmosphere port 16 and a purge port 22 are formed in the canister 18. The canister 18 comprises, in addition to the atmosphere port 16 and the purge port 22, an adsorption chamber for housing an adsorbent material, a cut off valve, etc. (not shown). The canister 18 prevents evaporated fuel from being released into the atmosphere by adsorbing the evaporated fuel in the fuel tank 50 into the adsorbent material. The fuel adsorbed by the adsorbent material is purged to an engine (not shown) via the purge port 22. There is no particular restriction on the specific configuration of the canister 18. For example, the configuration of the canister 18 taught in Japanese Patent Application Publication No. 2003-184664 may be adopted.

Figure 4:
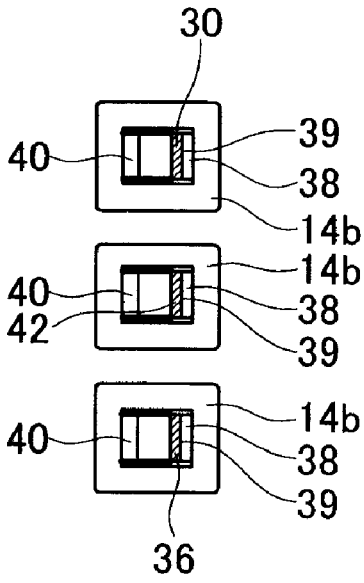
FIG. 4 is a view from above showing a connecting portion of a bus bar.

As shown in FIG. 2, a plurality of first bus bars 38 that is each arranged for respective electric connections passes with spaces between each other, through the plate body 14. The first bus bars 38 pass through the plate body 14 and extend from the interior of the fuel tank 50 to the exterior of the fuel tank 50. Moreover, a second bus bar 36 and a third bus bar 42 pass through the case 24, each of which makes electrical contact with the first bus bars 38 at a connecting portion 39 respectively (note that only one connecting portion 39 is shown in FIG. 2). FIG. 4 is a plan view from above showing the respective contacting portions 39 of the second bus bar 36, the third bus bar 42 (to be described later in detail), the first bus bar 38 and a bus bar 30 (to be described later in detail). As shown in FIG. 4, a surrounding wall 14*b* projecting upward from the plate body 14 surrounds the first bus bar 38. As shown in FIG. 2, an upper end of the surrounding wall 14*b* is at the same height as an upper surface of the outer peripheral edge 14*d*. A lower end of the first bus bar 38 within the fuel tank 50 is connected with a connector 44 connected with the fuel pump 46. The plate body 14 has a concave portion 14*a* between the canister 18 and the first bus bars 38. The concave portion 14*a* projects downward into the fuel tank 50 from the upper surface of the fuel tank 50. An outlet port 20 is disposed on the plate body 14. One end of the outlet port 20 is connected with the fuel pump 46, and the other end of the outlet port 20 is connected with a fuel passage (not shown) connected with the engine. Fuel discharged from the fuel pump 46 passes through the outlet port 20 and the fuel passage, and is supplied to the engine.

Figure 3:
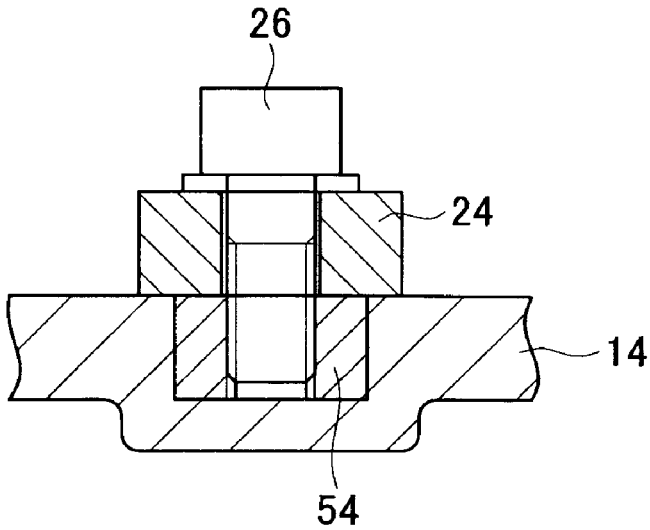
FIG. 3 is an enlarged view showing a connecting part of a plate body and a case.

The case 24 is fixed to an upper side of the plate body 14. The case 24 is disposed such that a clearance 52 is formed between the case 24 and the plate body 14. As shown in FIG. 3, the case 24 is screwed to the plate body 14 by screwing a male screw 26 into a female screw 54 inserted into the plate body 14. It may also be said that the case 24 and the plate body 14 are fixed to each other at one or more fixing portions (e.g. the male screw 26 and the female screw 54), while they are not making contact with each other with the clearance 52 therebetween at the rest of the portions.

As shown in FIG. 2, a controller chamber 48 is formed in the case 24. The controller chamber 48 comprises a first housing chamber 48*a* and a second housing chamber 48*b*. The first housing chamber 48*a* communicates with the second housing chamber 48*b*. The first housing chamber 48*a* is formed in the vicinity of the center of the plate body 14. The first housing chamber 48*a* is formed above the fuel tank 50. A first control circuit 34*a* of the control circuit 34 is housed in the first housing chamber 48*a*. The first control circuit 34*a* has an IC chip, or the like. The first control circuit 34*a* is fixed to a lower surface of an upper wall 24*a* that delineates the first housing chamber 48*a*. One end of the second bus bar 36 is connected with the first control circuit 34*a*. The second bus bar 36 passes through the case 24 and extends to the exterior of the case 24. The other end of the second bus bar 36 makes contact with the first bus bar 38 at the contacting portion 39.

The contacting portion 39 of the second bus bar 36 and the first bus bar 38 is surrounded by the surrounding wall 14*b* projecting from the plate body 14. One surface of the first bus bar 38 makes contact with an inner surface of the surrounding wall 14*b*. The other surface of the first bus bar 38 makes contact with one surface of the second bus bar 36. The other surface of the second bus bar 36 makes contact with a pressing member 40; the second bus bar 36 is thereby pressed toward the first bus bar 38 with the resilient force from the pressing member 40. The first bus bar 38 and the second bus bar 36 are caught and held between the surrounding wall 14*b* and the pressing member 40. Poor contact between the first bus bar 38 and the second bus bar 36 is thereby prevented. The contacting portion 39 of the second bus bar 36 and the first bus bar 38 is exposed to the atmosphere via the clearance 52.

The second housing chamber 48*b* is positioned in the concave portion 14*a* of the plate body 14. A second control circuit 34*b* is housed in the second housing chamber 48*b*. The second control circuit 34*b* has a condenser, etc. One end of the third bus bar 42 is connected with the second control circuit 34*b*. The third bus bar 42 passes through the case 24 and extends to the exterior of the case 24. As shown in FIG. 4, the other end of the third bus bar 42 makes contact with the first bus bar 38. As in the case of the first bus bar 38 and the second bus bar 36, the contacting portion 39 of the first bus bar 38 and the third bus bar 42 is also surrounded by the surrounding wall 14*b*. Further, the third bus bar 42 is pressed toward the first bus bar 38 by a pressing member 40. Poor contact between the first bus bar 38 and the third bus bar 42 is thereby prevented.

The external connector 28 is formed integrally with the case 24. The external connector 28 is disposed adjacent to the first housing chamber 48*a*. The external connector 28 opens upwards. A plurality of bus bars 30 is disposed in the external connector 28. The bus bars 30 pass through the case 24 and are connected with the control circuit 34, the fuel pump 46 or the like.

An upper end of the first housing chamber 48*a* is disposed at a position lower than the upper ends of the canister 18, the external connector 28, and other components 56 protruding from an upper surface of the plate body 14. That is, the first housing chamber 48*a* is surrounded by the components 18, 28, and 56.

A plurality of heat releasing fins 32 is disposed on an upper surface of the upper wall 24*a* that delineates the first housing chamber 48*a*. The heat releasing fins 32 are rectangular plates. The heat releasing fins 32 are disposed parallel to the direction of movement of the vehicle. The heat releasing fins 32 rise higher than the components 18, 28, and 56 surrounding the first housing chamber 48*a*.

A lower embankment wall 14*c* is formed in the plate body 14 in a loop surrounding the outer side of the second housing chamber 48*b* and the contacting portion 39. The lower embankment wall 14*c* protrudes upward beyond the upper surface of the fuel tank 50. Further, an upper embankment wall 24*b* is formed in the case 24 in a loop around the outer periphery of the lower embankment wall 14*c*. The upper embankment wall 24*b* extends downward past the upper end of the lower embankment wall 14*c*, and extends toward the plate body 14.

In the present embodiment, the clearance 52 is maintained between the walls of the case 24 defining the second housing chamber 48*b* and the concave portion 14*a* of the plate body 14. As is clearly shown in FIG. 2, the clearance 52 therefrom toward the canister 18 side is defined by the upper embankment wall 24*b* and the lower embankment wall 14*c*, the case 24 walls defining the first housing chamber 48*a* and the walls of the canister 18. The clearance 52 therefrom is communicated with the atmosphere outside the set plate 14. On the other side, the clearance 52 extends along and is defined by the bottom surface of the case 24, the contacting portion 39, the upper embankment wall 24*b* and the lower embankment wall 14*c*, and further communicates with the exterior atmosphere therefrom.

There may be an occasion in which the fuel within the fuel tank 50 may pass through the portion where the first bus bars 38 pass through the plate body 14, and leak out from the fuel tank 50. In such a case, the fuel that has leaked out reaches the contacting portion 39. In the above configuration, the contacting portion 39 communicates with the atmosphere via the clearance 52. As a result, the fuel that has leaked out passes through the clearance 52 and is dispersed into the atmosphere. Fuel can thereby be prevented from entering the controller chamber 48.

Further, the fuel within the fuel tank 50 may permeate through the plate body 14 and leak out to the exterior of the fuel tank 50. In the fuel supply device 10, the fuel that has permeated the plate body 14 is dispersed into the atmosphere from the clearance 52 without further permeating into the case 24. Fuel that has penetrated the plate body 14 can thereby be prevented from entering the controller chamber 48.

The set plate 12 is composed of the plate body 14 and the case 24 which are separately configured. It is consequently easy to form the clearance 52 between the plate body 14 and the case 24.

Further, in the fuel supply device 10, the lower embankment wall 14*c* is formed on the plate body 14, and the upper embankment wall 24*b* is formed on the case 24. It is thereby possible to prevent water existing in the outer atmosphere from entering the contacting portion 39 via the clearance 52.

Further, in the fuel supply device 10, the components 18, 28, and 56 are disposed around the circumference of the first housing chamber 48*a*. The components 18, 28, and 56 rise higher than the first housing chamber 48*a*. Foreign objects can thereby be prevented from making contact with the portion of the case 24 that defines the first housing chamber 48*a*. Damage to the first control circuit 34*a* within the first housing chamber 48*a* can thereby be prevented.

Further, the heat releasing fins 32 are disposed to be standing on the first housing chamber 48*a* to a height higher than the components 18, 28, and 56 surrounding the first housing chamber 48*a*. The cooling efficiency of the heat releasing fins 32 can thereby be increased.

Variants of the First Embodiment

Variants of the set plate 12 of the fuel supply device 10 of the first embodiment will be listed below. In the descriptions below, features differing from the set plate 12 of the first embodiment will chiefly be described. Further, in the variants below, components that are the same as in the first embodiment have the same reference numbers applied thereto, and a description thereof may be omitted.

Figure 5:
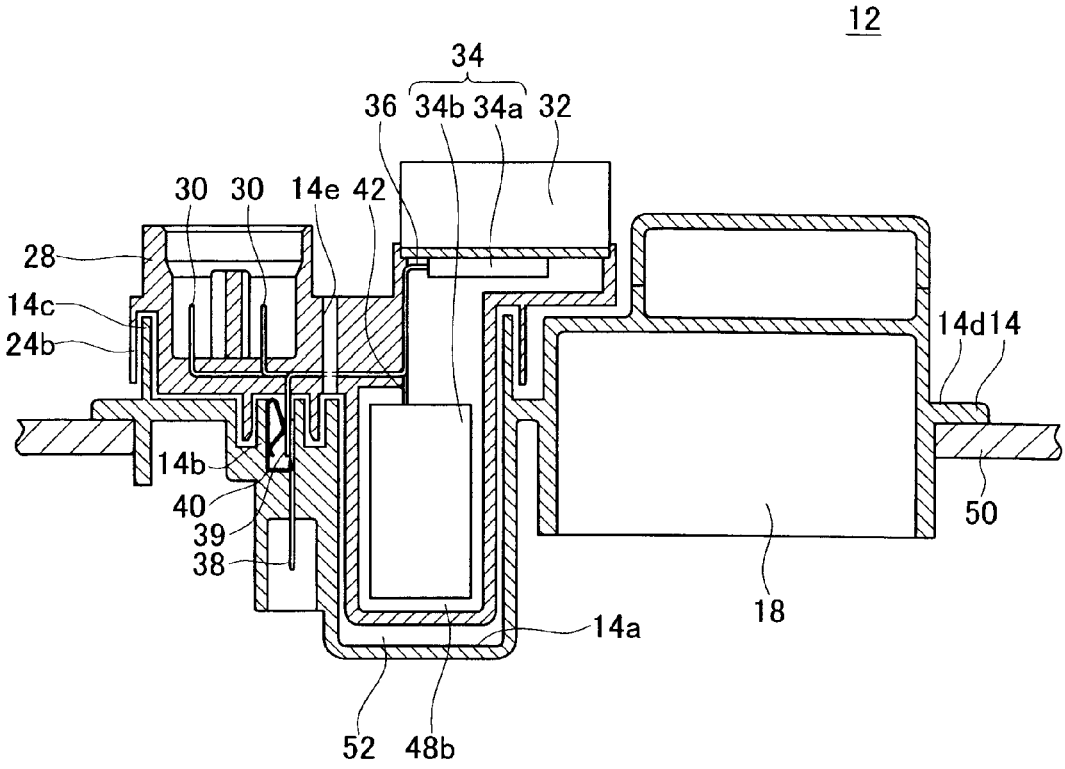
FIG. 5 is a cross-sectional view of a set plate of a first variant of the first embodiment.

FIG. 5 is a vertical cross-sectional view showing the set plate 12 of a first variant. A through hole 14*e* is formed in the case 24 of the set plate 12 of the first variant in the vicinity of the contacting portion 39. This through hole 14*e* extends from an upper surface of the case 24 to the clearance 52. That is, the through hole 14*e* extends to a surface that is exposed to a clearance 52 from the upper surface of the case 24 that is exposed to the atmosphere. According to this configuration, the fuel that has reached the clearance 52 from the interior of the fuel tank 50 can also pass through the through hole 14*e* and be dispersed into the atmosphere.

Figure 6:
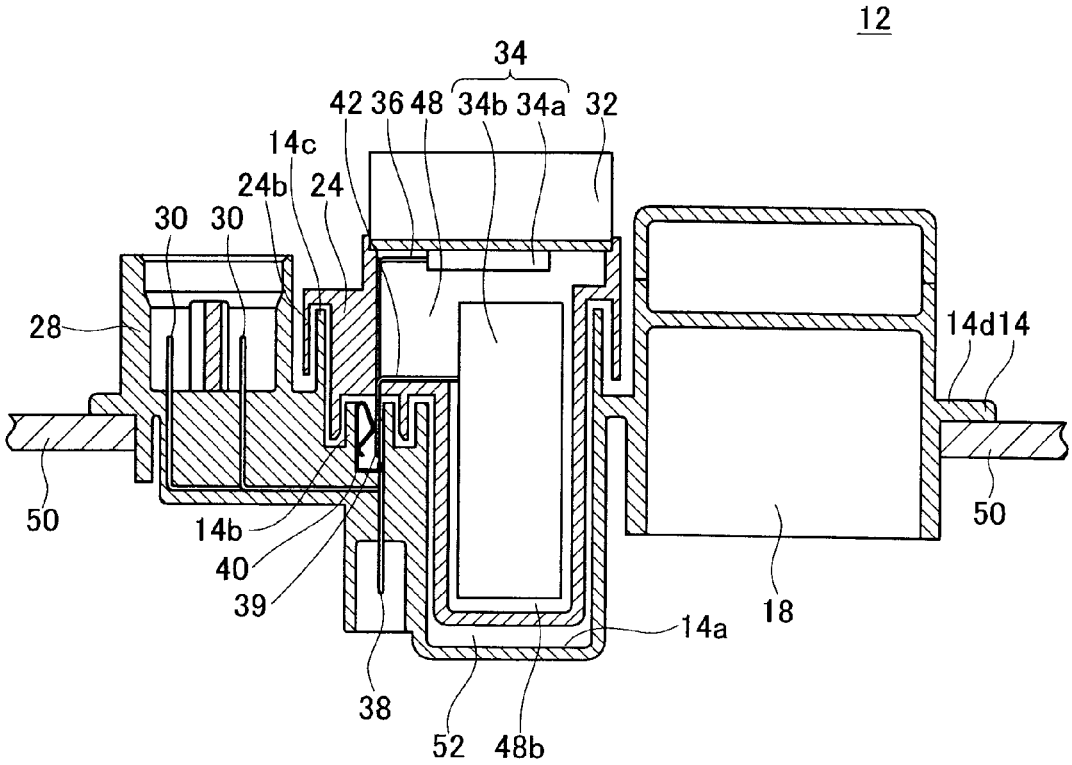
FIG. 6 is a cross-sectional view of a set plate of a second variant of the first embodiment.

FIG. 6 is a cross-sectional view showing the set plate 12 of a second variant. In the first embodiment, the external connector 28 is formed on the case 24. By contrast, in the set plate 12 of the second variant, the external connector 28 is formed on the plate body 14.

Figure 7:
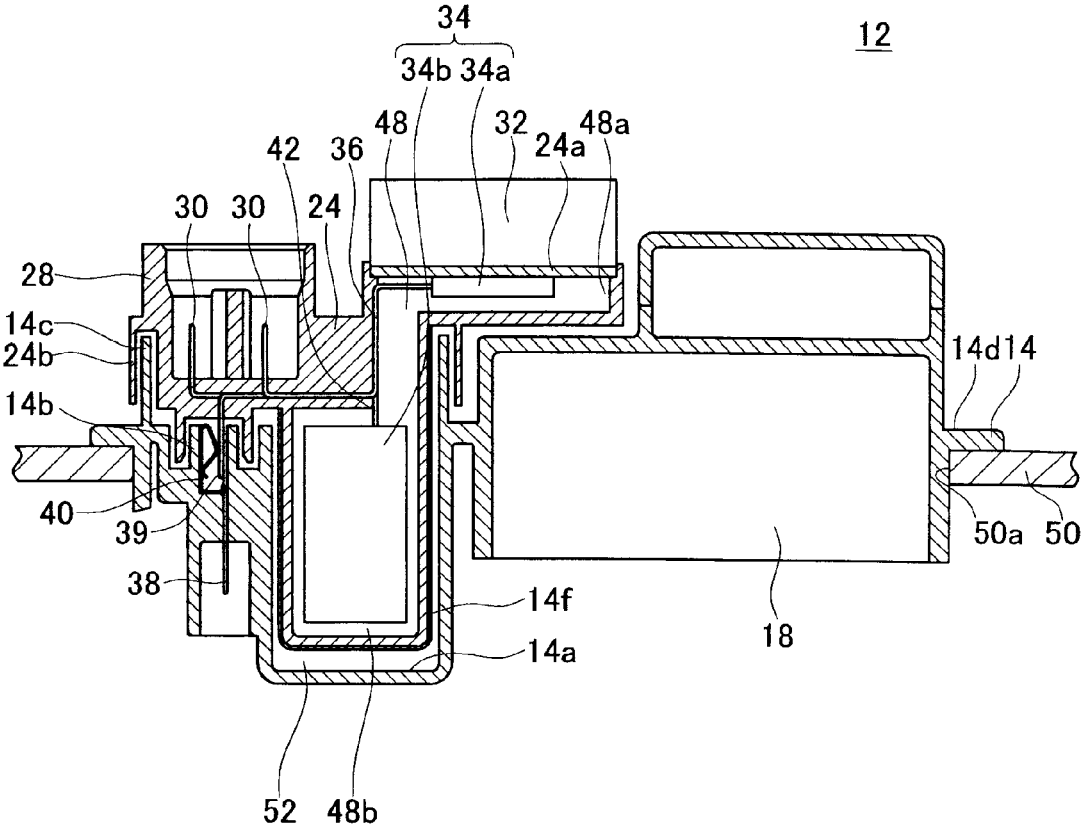
FIG. 7 is a cross-sectional view of a set plate of a third variant of the first embodiment.

FIG. 7 is a cross-sectional view showing the set plate 12 of a third variant. In the third variant, a surface coating 14*f* is applied to an outer surface of the case 24 that delineates the second housing chamber 48*b* of the first embodiment. The surface coating 14*f* utilizes a material having a lower degree of fuel permeation than the resin of the case 24, such as for example, DLC (diamond like carbon), fluorine, etc. Fuel can thereby be more effectively prevented from entering the second housing chamber 48*b* formed at the fuel tank 50 side. Alternatively, the surface coatings may be applied to both the inner surface and outer surface of the case 24 that defines the first housing chamber 48*a* and/or the second housing chamber 48*b*.

Second Embodiment

Figure 8:
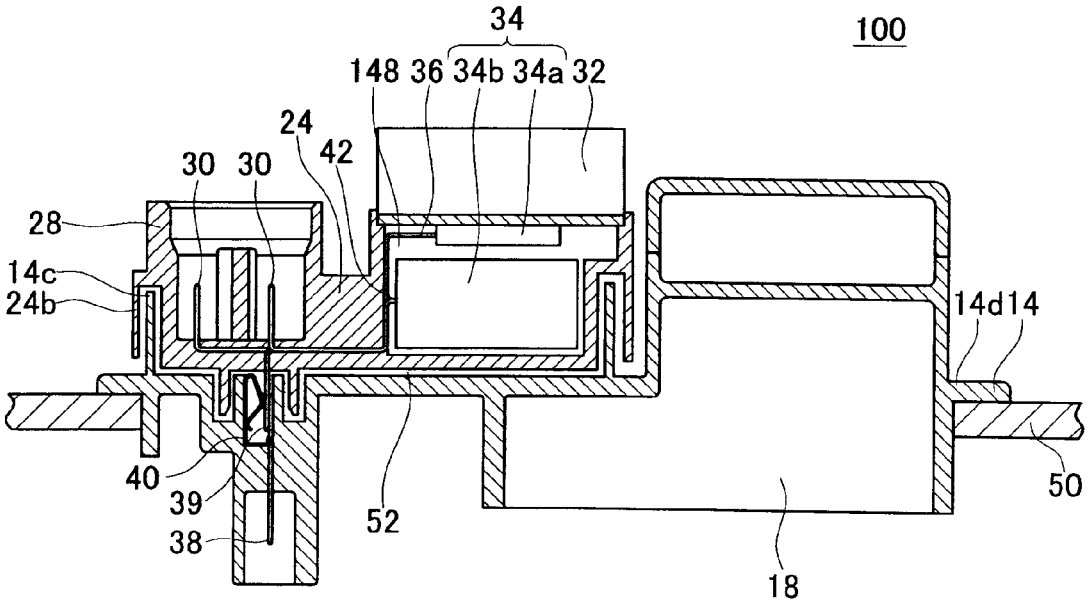
FIG. 8 is a cross-sectional view of a set plate of a second embodiment.

FIG. 8 is a cross-sectional view showing a set plate 100 of a fuel supply device 10 of a second embodiment. In the second embodiment, components that are the same as in the first embodiment have the same reference numbers applied thereto, and a description thereof may be omitted.

Similar to the configuration of the first control circuit 34*a*, the second control circuit 34*b* of the second embodiment is disposed above the outer peripheral edge 14*d* of the plate body 14. The first control circuit 34*a* and the second control circuit 34*b* are both housed within a controller chamber 148. According to this configuration, the same effects can also be obtained as from the fuel supply device 10 of the first embodiment.

Variants of the Second Embodiment

Variants of the set plate 100 of the fuel supply device 10 of the second embodiment will be given below. Points differing from the set plate 100 of the second embodiment will chiefly be described below. Further, in the variants below, components that are the same as in the second embodiment have the same reference numbers applied thereto, and a description thereof may be omitted.

Figure 9:
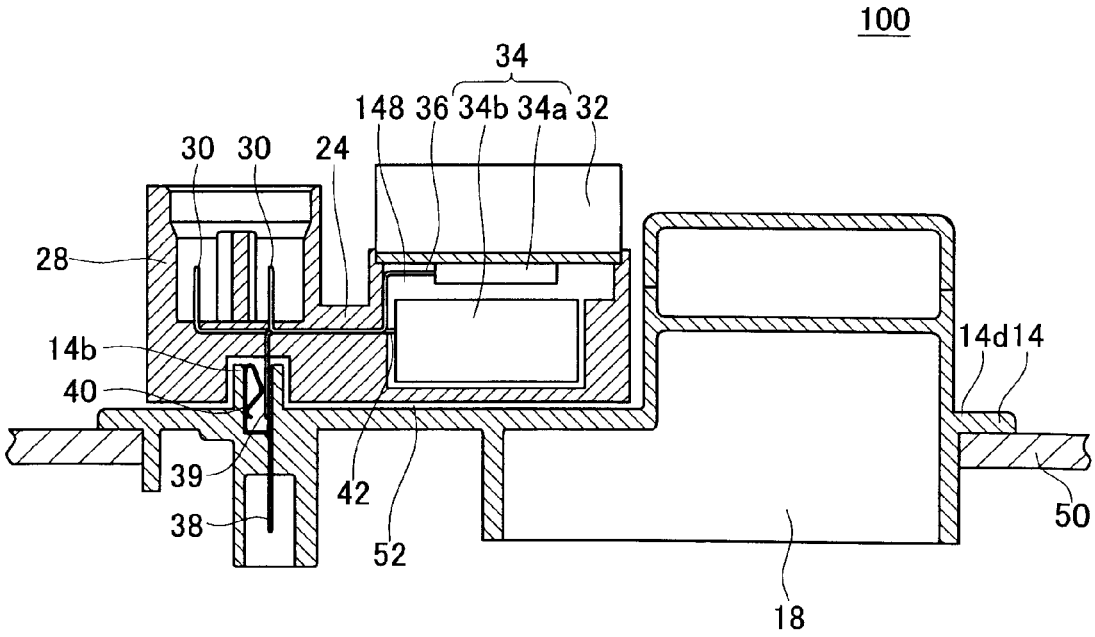
FIG. 9 is a cross-sectional view of a set plate of a first variant of the second embodiment.

FIG. 9 is a cross-sectional view showing the set plate 100 of a first variant. In the set plate 100 of the first variant, the surrounding wall 14*b* projects upward beyond the outer peripheral edge 14*d* of the plate body 14. In this configuration, the projecting wall 14*b* prevents water coming in from the outside of the clearance 52 from entering the contacting portion 39. As a result, there is no need to form the lower embankment wall 14*c* as is provided in the second embodiment.

Figure 10:
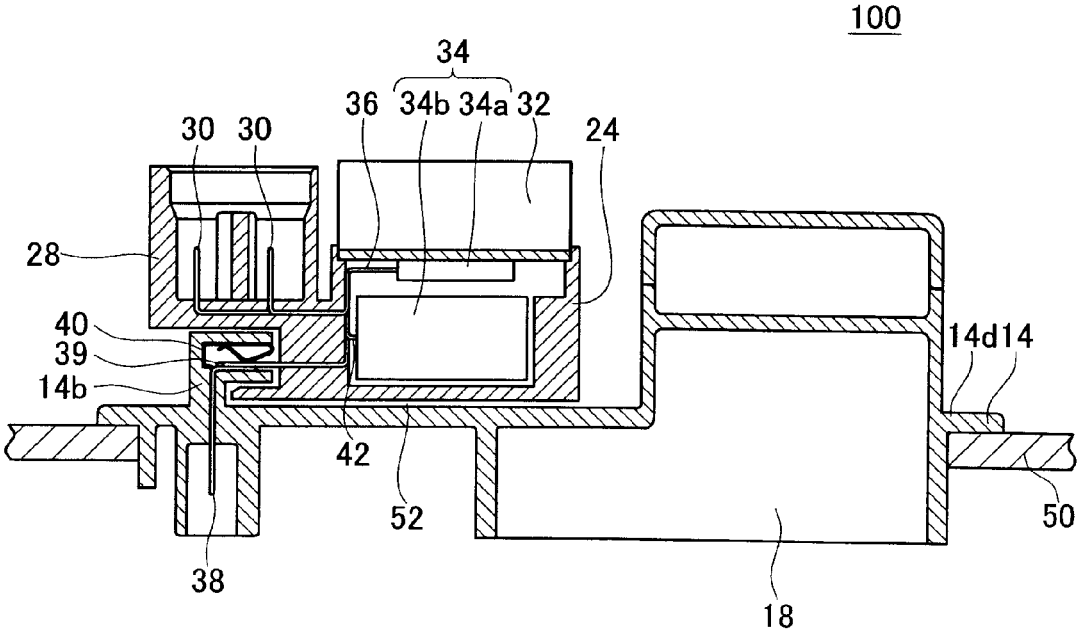
FIG. 10 is a cross-sectional view of a set plate of a second variant of the second embodiment.

FIG. 10 is a cross-sectional view showing the set plate 100 of a second variant. In the set plate 100 of the second variant, the surrounding wall 14*b* projects upward beyond the outer peripheral edge 14*d* of the plate body 14, and also curves toward a center of the set plate 100. Water from the outside can thereby be prevented from entering the contacting portion 39.

Figure 11:
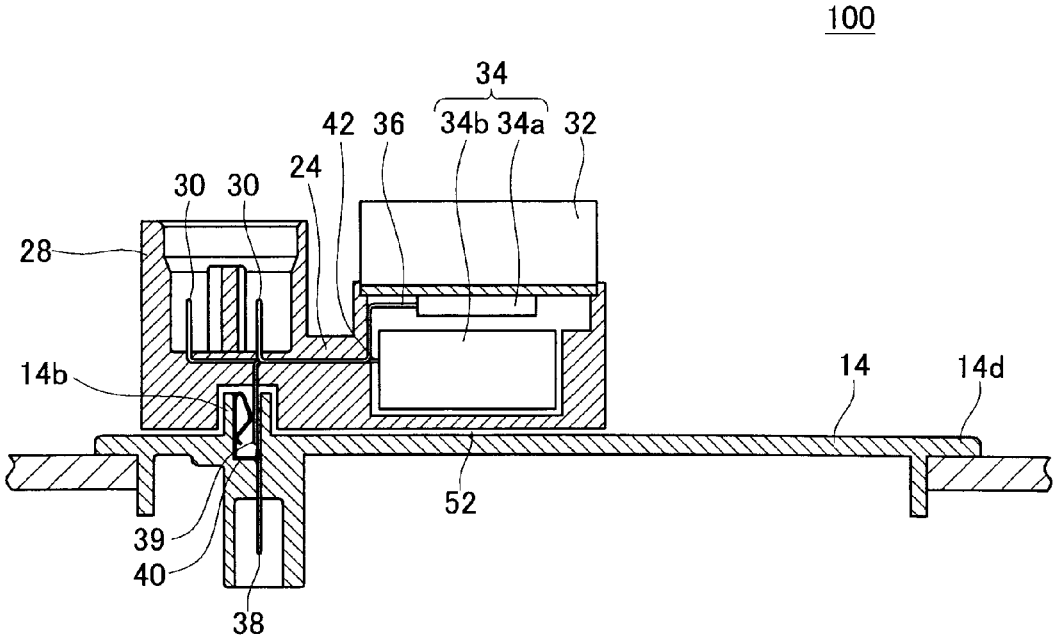
FIG. 11 is a cross-sectional view of a set plate of a third variant of the second embodiment.

FIG. 11 is a cross-sectional view showing the set plate 100 of a third variant. In the set plate 100 of the third variant, as in the case of the first variant (FIG. 9), the surrounding wall 14*b* projects upward beyond the outer peripheral edge 14*d* of the plate body 14. Further, a canister is not formed in the set plate 100 of the third variant. In this case, it is preferred that a canister is disposed outside the set plate 100.

Third Embodiment

Figure 12:
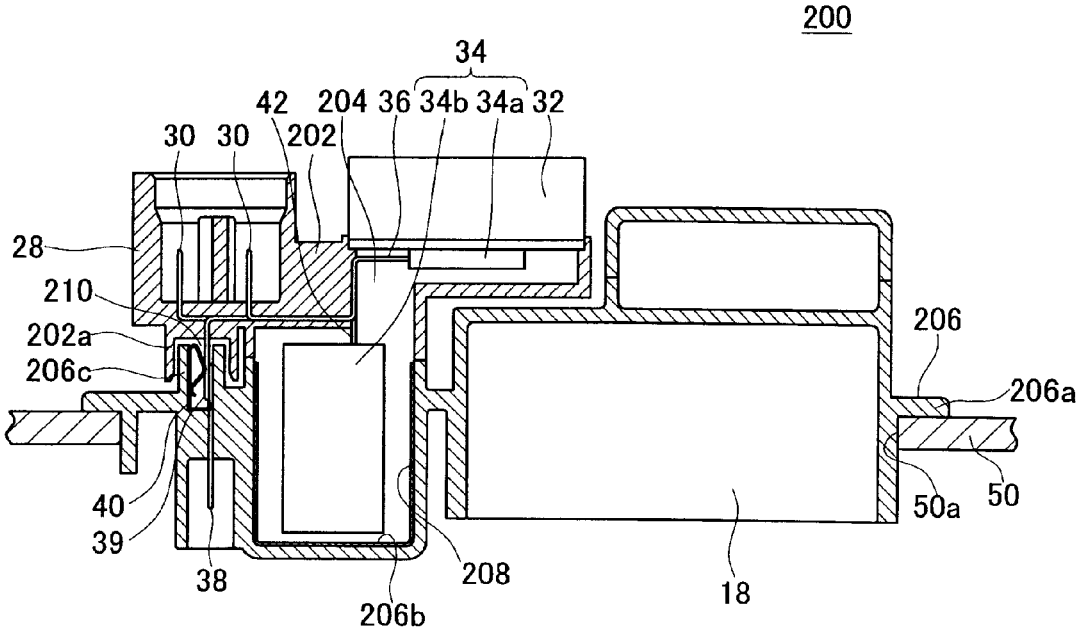
FIG. 12 is a cross-sectional view of a set plate of a third embodiment

FIG. 12 is a cross-sectional view showing a set plate 200 of a fuel supply device 10 of a third embodiment. In the third embodiment, components that are the same as in the first embodiment have the same reference numbers applied thereto, and a description thereof is omitted.

The set plate 200 is made from resin. The set plate 200 comprises a plate body 206 and a cover 202. The plate body 206 covers the opening 50*a* of the fuel tank 50. The position of the set plate 200 is fixed by an outer peripheral edge 206*a* of the plate body 206 making contact with the upper surface of the fuel tank 50. The canister 18 is formed in the plate body 206. A concave portion 206*b* is formed in the plate body 206, this concave portion 206*b* being adjacent to the canister 18 and extending further toward the fuel tank 50 than the outer peripheral edge 206*a*. An upper end of the concave portion 206*b* is open. A surface coating 208 is applied to the side and bottom inner surfaces of the concave portion 206*b*. The surface coating 208 utilizes a material having a lower fuel penetrating degree than the resin of the plate body 206 such as, for example, DLC, fluorine, etc. Further, a surrounding wall 206*c* is formed on the plate body 206. This surrounding wall 206*c* projects above the outer peripheral edge 206*a*. The first bus bars 38 are disposed at an inner side of the surrounding wall 206*c*, these first bus bars 38 passing through the plate body 206, and extending from the interior of the fuel tank 50 to the exterior of the fuel tank 50.

The cover 202 covers an opening at the upper end of the concave portion 206*b*. A controller chamber 204 is formed from the concave portion 206*b* of the plate body 206 and the space formed in the cover 202. The first control circuit 34*a* and the second control circuit 34*b* are housed in the controller chamber 204. The second bus bar 36 that is connected with the first control circuit 34*a* extends through the cover 202 and makes contact with the first bus bar 38 at an inner side of the surrounding wall 206*c*. The third bus bar 42 that is connected with the second control circuit 34*b* extends through the cover 202 and makes contact with the first bus bar 38 at the inner side of the surrounding wall 206*c*. The external connector 28 is formed in the cover 202. The external connector 28 is disposed above the surrounding wall 206*c*. A clearance 210 is formed between the plate body 206 and the cover 202 below the external connector 28. The contacting portion 39 of the second bus bar 36 and the third bus bar 42 extending from the control circuit 34, and the first bus bars 38 is exposed to the atmosphere via the clearance 210.

The upper embankment wall 202*a* that forms a loop around the periphery of the surrounding wall 206*c* is formed on a lower surface of the cover 202 positioned below the external connector 28.

In the fuel supply device 10 of the third embodiment, the contacting portion 39 of the second bus bar 36 and the third bus bar 42 extending from the control circuit 34, and the first bus bars 38 is exposed to the atmosphere via the clearance 210. Since the fuel leaking out from within the fuel tank 50 along and between the first bus bar 38 and the plate body 206 is thereby dispersed into the atmosphere, it is possible to prevent the fuel from entering the controller chamber 204.

Further, the surface coating 208 is applied to the side and bottom inner surfaces of the concave portion 206*b* that delineate the controller chamber 48. The fuel permeation can thereby be prevented from entering the controller chamber 204.

Fourth Embodiment

Figure 13:
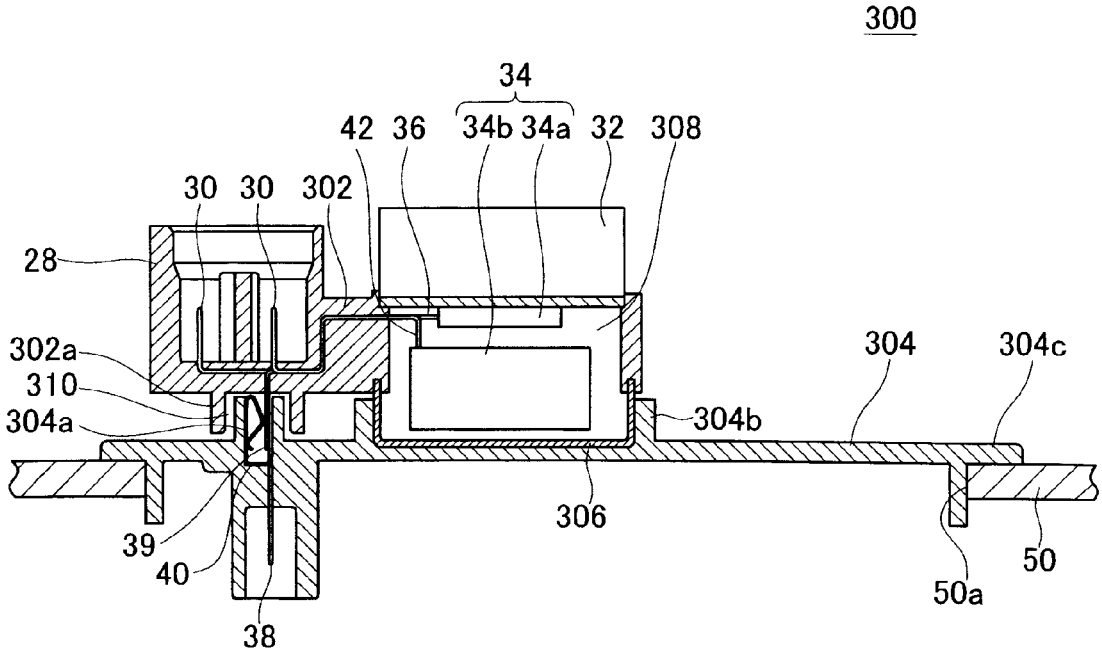
FIG. 13 is a cross-sectional view of a set plate of a fourth embodiment.

FIG. 13 is a cross-sectional view showing a set plate 300 of a fuel supply device 10 of a fourth embodiment. In the fourth embodiment, components that are the same as in the third embodiment have the same reference numbers applied thereto, and a description thereof may be omitted.

The set plate 300 is made from resin. The set plate 300 comprises a plate body 304 and a cover 302. The plate body 304 covers the opening 50*a* of the fuel tank 50. The position of the set plate 300 is fixed by an outer peripheral edge 304*c* of the plate body 304 making contact with the upper surface of the fuel tank 50. A surrounding wall 304*a* and a projecting wall 304*b* protrude from an upper surface of the plate body 304. The surrounding wall 304*a* forms a cylindrical loop. The first bus bars 38 are disposed inside the loop of the surrounding wall 304*a*. These first bus bars 38 extend from the interior of the fuel tank 50, passing through the plate body 304, and extending to the exterior of the fuel tank 50.

The projecting wall 304*b* also forms a cylindrical loop. An inner wall 306 that is in the shape of a cylinder with a base is fixed to the inner side of the projecting wall 304*b*. The inner wall 306 is made from metal material. An upper end of the inner wall 306 is open.

The cover 302 covers the opening of the upper end of the inner wall 306. A controller chamber 308 is defined with a space formed by the cover 302 and the inner wall 306 of the plate body 304. The first control circuit 34*a* and the second control circuit 34*b* are housed in the controller chamber 308. The second bus bar 36 connected with the first control circuit 34*a* extends through the cover 302 and makes contact with the first bus bar 38 at the inner side of the surrounding wall 304*a*. The third bus bar 42 connected with the second control circuit 34*b* extends through the cover 302 and makes contact with the first bus bar 38 at an inner side of the surrounding wall 304*a*. The external connector 28 is formed in the cover 30. The external connector 28 is disposed above the surrounding wall 304*a*. A clearance 310 is formed below the external connector 28 between the plate body 304 and the cover 302. The contacting portion 39 of the second bus bar 36 and the third bus bar 42 extending from the control circuit 34, and the first bus bars 38 is exposed to the atmosphere via the clearance 310.

The upper embankment wall 302*a* is formed in a lower surface at a position of the cover 302 below the external connector 28, this upper embankment wall 302*a* forming a loop around a periphery of the surrounding wall 304*a* with the clearance 310 therebetween.

In the fuel supply device 10 of the fourth embodiment, the contacting portion 39 of the second bus bar 36, the third bus bar 42 and the first bus bar 38 is exposed to the atmosphere via the clearance 310. Since the fuel within the fuel tank 50 is thereby dispersed from the clearance 310 into the atmosphere even if it has leaked out from the contact between the first bus bar 38 and the plate body 304, it is possible to prevent the fuel from entering the controller chamber 308.

Further, metal material is utilized in manufacturing the inner wall 306 that delineates the controller chamber 308. The fuel can thereby be prevented from permeating into the controller chamber 308.

Variant of the Fourth Embodiment

Figure 14:
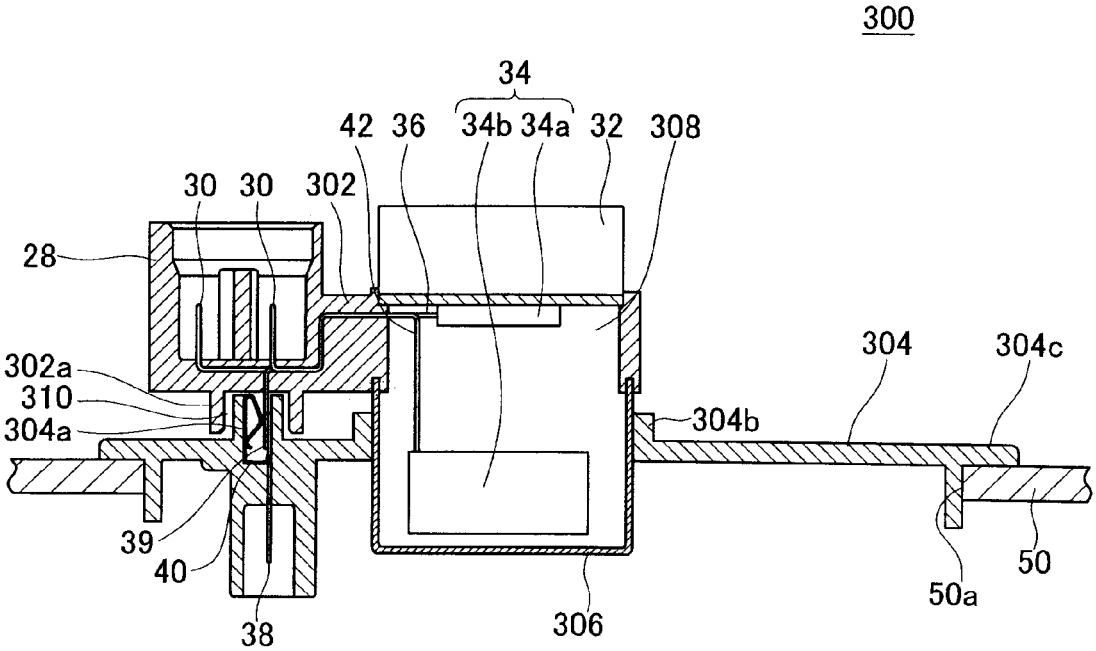
FIG. 14 is a cross-sectional view of a set plate of a variant of the fourth embodiment.

FIG. 14 is a cross-sectional view showing the set plate 300 of a variant of the fourth embodiment. In the set plate 300 of the variant, a part of an outer surface of the inner wall 306 disposed at the inner side of the surrounding wall 304*b* is exposed to the interior of the fuel tank 50. According to this configuration, the control circuit 34 within the controller chamber 308 can be cooled by the fuel within the fuel tank 50. Since the inner wall 306 is made from metal material, the fuel within the fuel tank 50 does not permeate into the controller chamber 308.

Furthermore, in the configuration of this variant, the side surface of the inner wall 306 exposed to the outer atmosphere between the surrounding wall 304*b* and the cover 302 is designed large. In addition, the clearance 310 adjacent to the said portion of the inner wall 306 is formed large, so that the cooling efficiency can thereby be improved.

Some of the technical features of the embodiments will be described.

In the aforementioned fuel supply device, the set plate may comprise a plate body and a case. The plate body may be attached to the opening of the fuel tank. The case may have the controller chamber. The case may be fixed to the plate body. A clearance may be disposed between the plate body and the case and may communicate with the atmosphere.

In this fuel supply device, the fuel within the fuel tank may pass through the plate body toward the controller chamber, either by leaking or permeating in between the plate body and the wirings arranged therein. Since the clearance that communicates with the atmosphere is disposed between the plate body and the case, the fuel that has reached the clearance diffuses into the atmosphere. Therefore, the fuel is thus prevented from entering the controller chamber.

In this fuel supply device, the electrical wiring member may comprise a first electrical wiring member and a second electrical wiring member. The first electrical wiring member may be passed through the plate body. The second electrical wiring member may be passed through the case. The first electrical wiring member may be connected with the second electrical wiring member at the clearance between the plate body and the case. With the electrical wiring members being wired through inside the plate body and/or the case, and that the electrical wiring member and its aforementioned counterpart being independently composed, there is a possibility that fuel, either in the form of vapor or liquid, may permeate in between the wiring pathway thereof and flow out of the fuel tank.

According to this configuration, the fuel that has traveled along the first electrical wiring member diffuses to the atmosphere at the clearance. Consequently, the fuel is prevented from traveling along the second electrical wiring member and entering the controller chamber.

This fuel supply device may further comprise a pressing member at a position where the first electrical wiring member and the second electrical wiring member make contact with each other. The pressing member may press one of the first electrical wiring member and the second electrical wiring member towards the other of the first electrical wiring member and the second electrical wiring member.

According to this configuration, it is possible to prevent poor contact caused by vibration, etc. from occurring between the first electrical wiring member and the second electrical wiring member.

This fuel supply device may further comprise a frame member surrounding the first electrical wiring member, the second electrical wiring member and the pressing member.

According to this configuration, the first electrical wiring member, the second electrical wiring member and the pressing member may be caught and embraced closely by the surrounding member to maintain tight contact with each other. It is possible to more effectively prevent poor contact between the first electrical wiring member and the second electrical wiring member.

In this fuel supply device, the case may comprise a through hole extending from a surface exposed to the atmosphere to a surface facing the clearance between the plate body and the case.

According to this configuration, fuel that has reached the clearance can be diffused more effectively to the atmosphere.

In this fuel supply device, at least a part of a peripheral wall of the controller chamber may be made of a material that has a lower fuel penetrating degree than a main material of the set plate.

According to this configuration, the entry of fuel into the controller chamber can be prevented more effectively. It should be noted that "at least a part of a peripheral wall . . . " means that at least a part of the wall(s) of the controller chamber (e.g. some of the walls composing the controller chamber, or parts thereof) is made of such material.

In the above construction, at least a part of an inner and/or outer surface of the peripheral wall may be coated with a material that has a lower fuel penetrating degree than a main material of the set plate. Alternatively, at least a part of the peripheral wall may be made of a metal material.

In the case where at least a part of the peripheral wall(s) is made of the metal material, at least a part of the peripheral wall made of the metal material may be exposed within the fuel tank.

According to this configuration, the control circuit within the controller chamber can be cooled by the fuel within the fuel tank.

This fuel supply device may further comprise a heat releasing fin. The heat releasing fin may be disposed on one part of the peripheral wall of the controller chamber, and exposed to the atmosphere.

According to this configuration, the cooling of the control circuit can be accelerated.

This fuel supply device may further comprise a projecting member. The projecting member may be disposed surrounding the controller chamber on the set plate. This projecting member may project from the set plate higher than the controller chamber.

According to this configuration, the controller chamber can be prevented from making contact with external objects. Damage to the control circuit within the controller chamber can thereby be prevented.

This fuel supply device may further comprise an embankment wall. The embankment wall may project from set plate and surrounding a position where the electrical wiring member is exposed to the atmosphere.

According to this configuration, it is thereby possible to prevent water from reaching the electrical wiring member.

According to the technology disclosed in the present specification, fuel can effectively be prevented from entering the controller chamber. The reliability of the fuel supply device can thereby be increased.

A fuel leakage prevention member may be applied to a pathway of the electrical wiring member at a side further toward the fuel tank than a part of the pathway that is exposed to the atmosphere.

The first bus bar 38, the second bus bar 36, and the third bus bar 42 are examples of the electrical wiring member, however, the electrical wiring member need not be a bus bar. For example, the electrical wiring member may be a cable, etc.

The plate body and the case are fixed to each other with the clearance formed at a local (partial) area therebetween.

Variants will be described below that can be utilized in the embodiments described above. The description will be given below using the reference numbers of the first embodiment.

Figure 15:
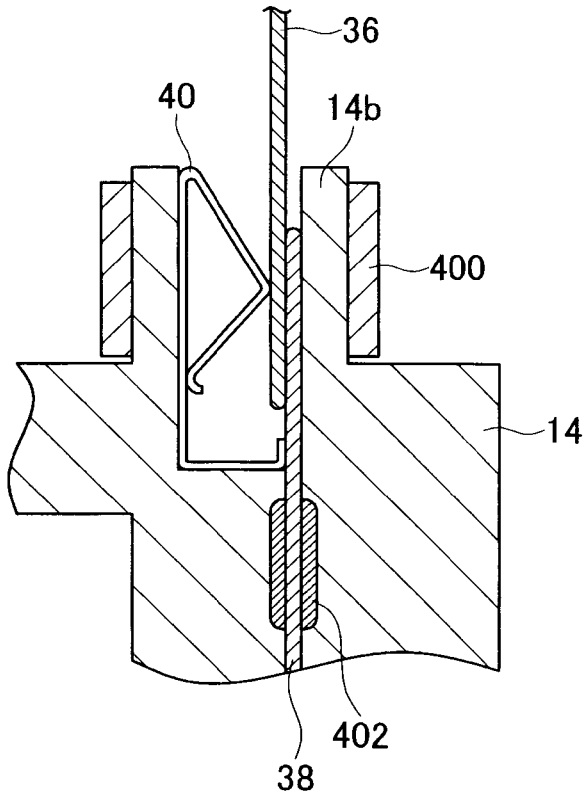
FIG. 15 is a cross-sectional view of a connecting portion of a bus bar of another variant of the above embodiments.
Figure 16:
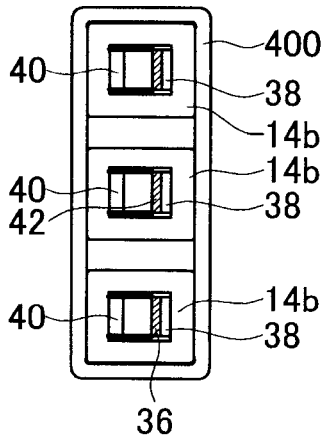
FIG. 16 is a view from above showing a connecting portion of a bus bar of another variant of the above embodiments.

For example, the configuration shown in FIGS. 15 and 16 may be utilized. FIG. 15 is a view of an extract from the vicinity of the contacting portion 39 of the first bus bar 38 and the second bus bar 36. FIG. 16 is a top view of the contacting portion 39. As shown in FIGS. 15 and 16, a frame member 400 is disposed at an outer periphery of the surrounding wall 14*b*. According to this configuration, the contact between the bus bars 36, 38 are supported by the frame member 400 in a direction of being strengthened; the contact becoming loose can thus be prevented.

Further, as shown in FIG. 15, an leakage prevention agent 402 that prevents the fuel within the fuel tank 50 from leaking out along the first bus bars 38, such as a sealant or the like, may be applied to a pathway of the first bus bar 38 that extends from the interior of the fuel tank 50 to the exterior of the fuel tank 50, this leakage prevention agent 402 being applied at a side that is further toward the fuel tank 50 than the contacting portion 39. According to this configuration, fuel can more reliably be prevented from entering the controller chamber 48.

Figure 17:
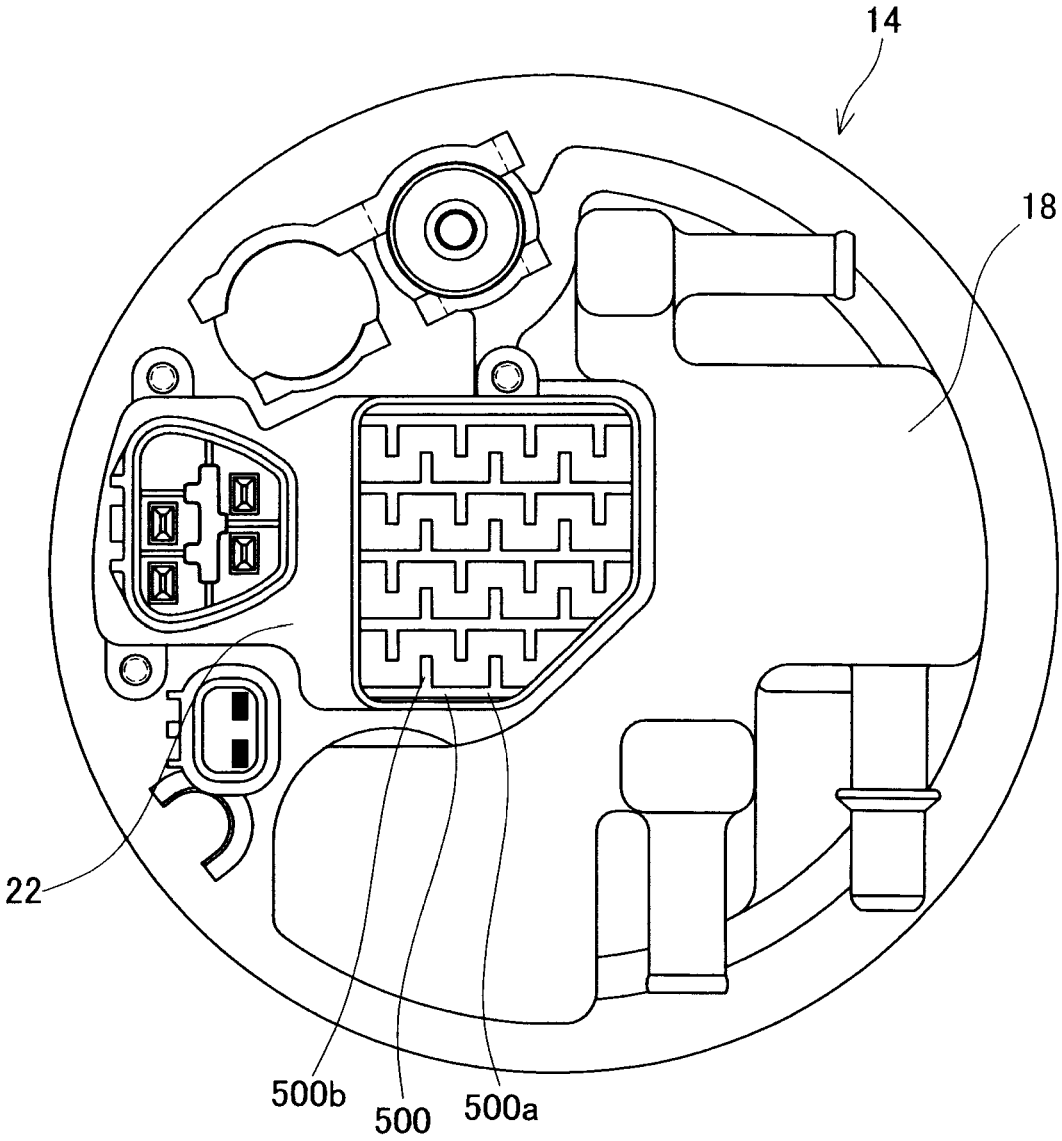
FIG. 17 is a figure showing a variant of a heat releasing fin.
Figure 18:
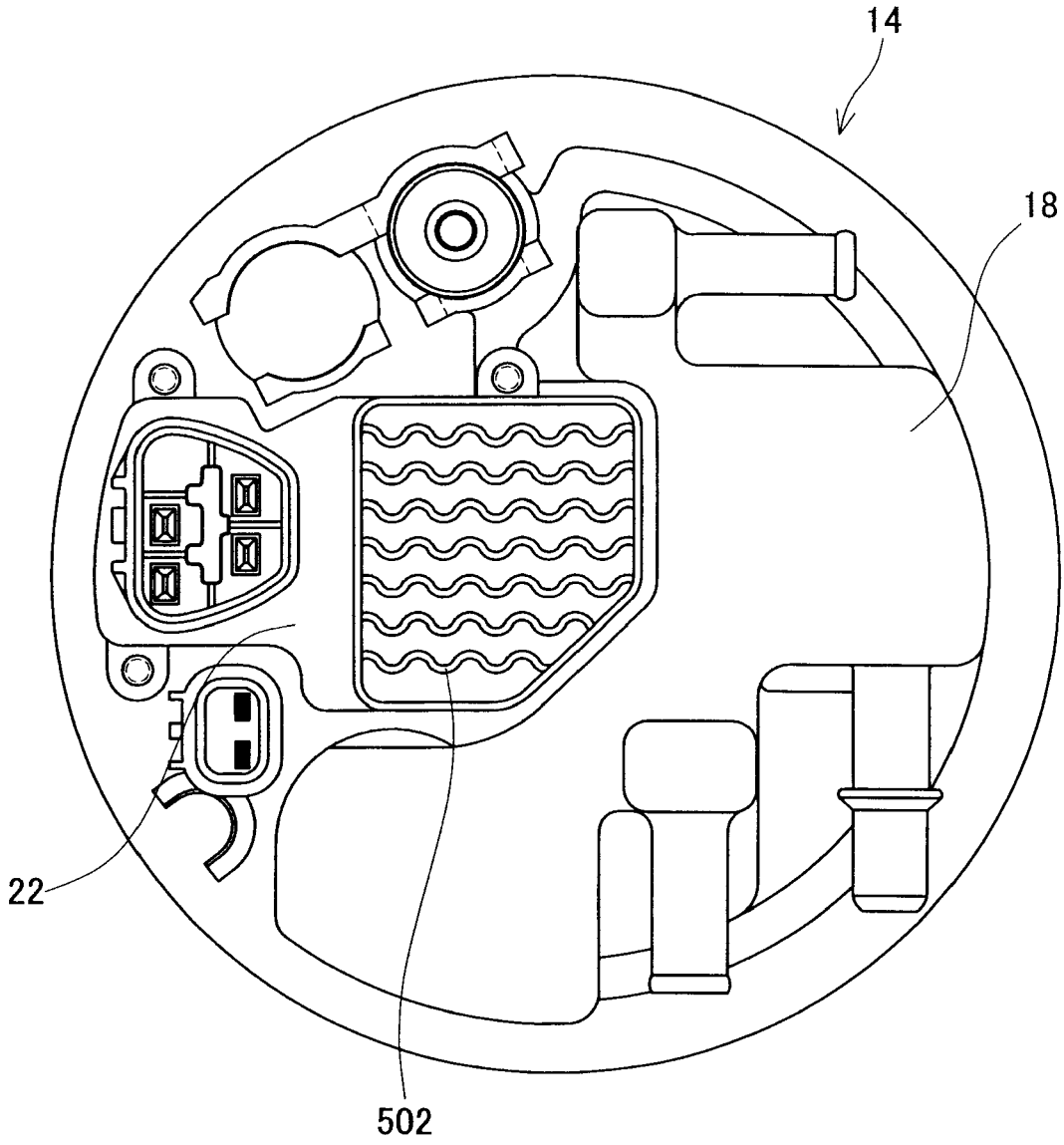
FIG. 18 is a figure showing a variant of the heat releasing fin.
Figure 19:
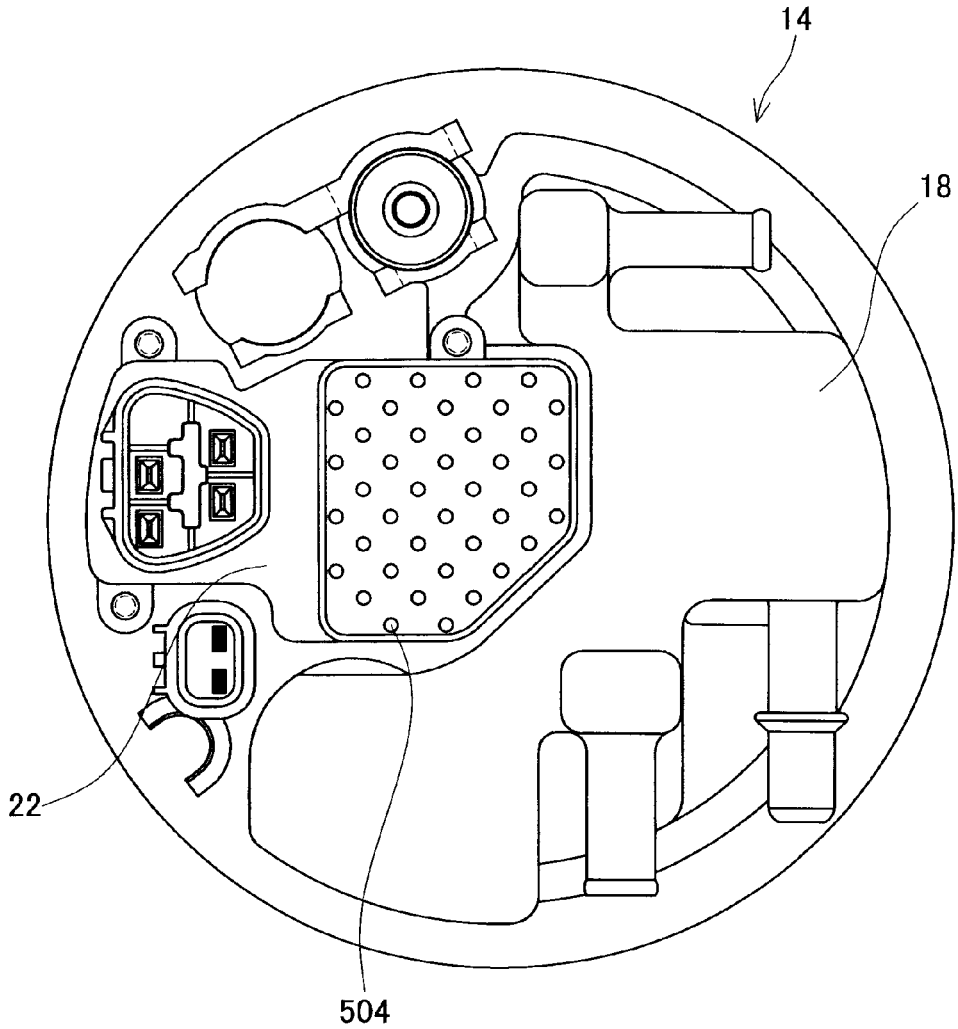
FIG. 19 is a figure showing a variant of the heat releasing fin.

The heat releasing fin may have a shape differing from the heat releasing fins 32 shown in FIG. 1. FIG. 17 to FIG. 19 show variants of the heat releasing fin. As shown in FIG. 17, a heat releasing fin 500 comprises a rectangular main heat releasing fin 500*a* disposed parallel to the direction of movement of the vehicle, and a plurality of sub heat releasing fins 500*b* that extend perpendicularly to the heat releasing fin 500*a*. Further, as shown in FIG. 18, a heat releasing fin 502 may be corrugated. Alternatively, as shown in FIG. 19, a heat releasing fin 504 may be columnar shaped. According to these configurations, the surface area of the heat releasing fins may be increased. The cooling effectiveness of the control circuit 34 can thereby be increased.

Figure 20:
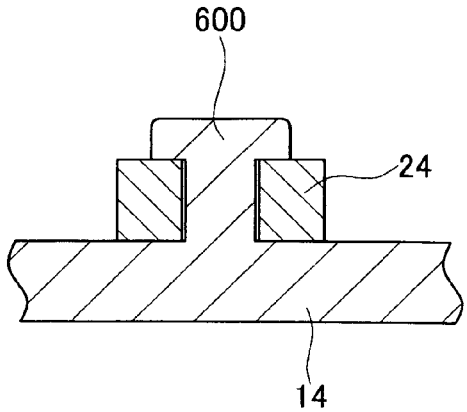
FIG. 20 is an enlarged view showing a connecting part of a plate body and a case of another variant of the above embodiments.

As described in the first embodiment (FIG. 3), the case 24 is screwed to the plate body 14. However, as shown in FIG. 20, the case 24 may be crimped to the plate body 14 by passing a protrusion 600 that protrudes from the plate body 14 through a through hole of the case 24 and then crushing an upper end of the protrusion 600.

What is claimed is:

1. A fuel supply device, comprising:

a fuel pump disposed within a fuel tank;

a set plate closing an opening of the fuel tank and comprising a controller chamber isolated from an interior of the fuel tank;

a control circuit controlling the fuel pump and disposed within the controller chamber; and an electrical wiring member connecting the control circuit and the fuel pump, wherein the electrical wiring member is arranged from an interior of the controller chamber to the interior of the fuel tank and passed through the set plate, and a part of the electrical wiring member is exposed to the atmosphere wherein the exposed part is disposed within a range from the interior of the fuel tank to the interior of the controller chamber.

2. The fuel supply device as in claim 1, wherein the set plate comprises a plate body attached to the opening of the fuel tank and a case having the controller chamber, the case is fixed to the plate body, and a clearance is disposed between the plate body and the case and communicates with the atmosphere.

3. The fuel supply device as in claim 2, wherein the electrical wiring member comprises a first electrical wiring member passed through the plate body and a second electrical wiring member passed through the case, the first electrical wiring member is connected with the second electrical wiring member at the clearance between the plate body and the case.

4. The fuel supply device as in claim 3, further comprising:

a pressing member at a position where the first electrical wiring member and the second electrical wiring member make contact with each other, wherein the pressing member presses one of the first electrical wiring member and the second electrical wiring member toward the other of the first electrical wiring member and the second electrical wiring member.

5. The fuel supply device as in claim 4, further comprising:

a frame member surrounding the first electrical wiring member, the second electrical wiring member and the pressing member, wherein the frame member supports the first electrical wiring member, the second electrical wiring member and the pressing member in a direction of contact such that the contact between the first electrical wiring member and the second electrical wiring member is tightened by the frame member.

6. The fuel supply device as in claim 2, wherein the case comprises a through hole extending from a surface exposed to the atmosphere to a surface facing the clearance between the plate body and the case.

7. The fuel supply device as in claim 1, wherein at least a part of a peripheral wall of the controller chamber is made of a material that has a lower degree of fuel permeation than a main material of the set plate.

8. The fuel supply device as in claim 7, wherein at least a part of an inner surface of the peripheral wall is coated with a material that has a lower degree of fuel permeation than the main material of the set plate.

9. The fuel supply device as in claim 7, wherein at least a part of an outer surface of the peripheral wall is coated with a material that has a lower degree of fuel permeation than the main material of the set plate.

10. The fuel supply device as in claim 7, wherein at least a part of the peripheral wall is made of a metal material.

11. The fuel supply device as in claim 10, wherein at least a part of the peripheral wall made of the metal material is exposed within the fuel tank.

12. The fuel supply device as in claim 1, further comprising a heat releasing fin disposed on one part of a peripheral wall of the controller chamber, and exposed to the atmosphere.

13. The fuel supply device as in claim 1, further comprising a projecting member disposed surrounding the controller chamber on the set plate, and projecting from the set plate higher than the controller chamber.

14. The fuel supply device as in claim 1, further comprising an embankment wall projecting from the set plate and surrounding a position where the electrical wiring member is exposed to the atmosphere.

* * * * *